United States Patent [19]

Bates et al.

[11] 4,202,708

[45] May 13, 1980

[54] CORROSION RESISTANT COPPER BASE ALLOYS FOR HEAT EXCHANGER TUBE

[75] Inventors: John F. Bates, Lake Charles, La.; James M. Popplewell, Guilford, Conn.

[73] Assignee: Olin Corporation, New Haven, Conn.

[21] Appl. No.: 968,885

[22] Filed: Dec. 13, 1978

Related U.S. Application Data

[62] Division of Ser. No. 879,145, Feb. 21, 1978, Pat. No. 4,171,972.

[51] Int. Cl.[2] ..... C22C 9/06; C22F 1/08

[52] U.S. Cl. ..... 148/11.5 C; 148/13.2

[58] Field of Search ..... 75/153, 157.5, 159, 75/162; 148/11.5 C, 12.7 C, 160, 13.2, 2

[56] References Cited

U.S. PATENT DOCUMENTS

| | | | |
|---|---|---|---|
| 1,277,989 | 9/1918 | Milliken | 75/159 X |
| 1,393,388 | 10/1921 | Milliken | 75/157.5 |
| 1,992,118 | 2/1935 | Brownsdon et al. | 148/12.7 C |
| 2,101,930 | 12/1937 | Davis et al. | 75/159 X |
| 2,309,101 | 1/1943 | Crampton | 75/157.5 |
| 3,403,997 | 10/1968 | Badia | 148/12.7 C |
| 3,698,965 | 10/1972 | Ence | 148/11.5 C X |
| 3,703,367 | 11/1972 | Cocks | 75/162 X |

FOREIGN PATENT DOCUMENTS

| | | | |
|---|---|---|---|
| 128476 | 8/1948 | Australia | 148/11.5 C |
| 425547 | 3/1935 | United Kingdom | 148/12.7 C |

*Primary Examiner*—L. DeWayne Rutledge
*Assistant Examiner*—Peter K. Skiff
*Attorney, Agent, or Firm*—Paul Weinstein

[57] ABSTRACT

An alloy system is disclosed which is particularly useful for heat exchanger and water tubing applications. This alloy system utilizes additions of zinc, nickel and iron to a copper base. Cobalt and manganese may also be added to the alloy and such elements as arsenic, antimony and phosphorus may be added as parting inhibitors to the system.

14 Claims, No Drawings

CORROSION RESISTANT COPPER BASE ALLOYS FOR HEAT EXCHANGER TUBE

This is a Division, of application Ser. No. 879,145, filed Feb. 21, 1978 now U.S. Pat. No. 4,171,912.

BACKGROUND OF THE INVENTION

Copper base alloys have been extensively utilized in tubing for heat exchanger applications. These alloys, in particular the copper-nickel alloys, have found wide acceptance due to their good balance of corrosion resistance and mechanical properties. In particular, such alloys as Alloy 706 and 715 (containing, respectively, 10% and 30% nickel in a copper base) are used in tubular form in surface condenser heat exchangers in power generating plants, particularly those using polluted waters containing sulfides. In such environments, Alloy 706 has been shown to have the best overall performance of any commercially available copper alloy tubing material. These alloys, although widely used, do present difficulties of their own. In particular, at least 10% nickel is usually necessary in the alloys to achieve good corrosion resistance. This tends to make the alloys quite expensive and therefore uncompetitive with other non-copper alloy systems.

Various alloy systems have been developed to overcome the high cost of the copper-nickel alloy systems. These alloy systems have generally not been able to provide the high corrosion resistance properties of the copper-nickel alloys in heat exchanger applications. Alloy systems have been developed for their corrosion resistance properties which utilize varied alloy additions for such properties. For example, U.S. Pat. Nos. 3,627,593, 3,703,367 and 3,713,814 all utilize various additions of nickel to copper-zinc alloy bases to provide increased corrosion resistance along with increased strength properties. U.S. Pat. No. 3,627,593 utilizes a basic copper-nickel-zinc alloy to provide these properties while U.S. Pat. No. 3,703,367 utilizes titanium additions together with aluminum or nickel additions or both to copper-zinc alloy bases to provide these increases in properties to the alloy systems. This particular patent specifically utilizes these materials in water tubing. U.S. Pat. No. 3,713,814 utilizes a copper-zinc base to which are added various alloying elements such as lead, nickel, manganese and aluminum, among others, to provide an alloy system which exhibits good resistance against corrosion.

Various Japanese scientists have studied the effect of additives to particular copper alloy systems to determine the effect of these additives upon corrosion properties of the systems. In particular, Nagasaki et al. have indicated in their report "Effect of Additives on Dezincification Rate of Alpha-Brass at High Temperature in Vacuum" in the *Journal of the Japan Institute of Metals*, Volume 34, No. 3 on Pages 343 to 347 that various elements including iron, cobalt and nickel may be added in ranges up to 1 or 2% to prevent the dezincification of copper base alloys. In each of the examples within this particular reference, the zinc content of each specimen is 30% by weight. Otsu et al. have discovered in their "Study of Corrosion of Copper Alloys in High Temperature Water and Steam" in the *Sumitomo Light Metal Technical Reports* issued in January, 1960, January, April, July and October, 1964 and in July, 1965 that the addition of small amounts of such elements as iron, nickel, arsenic, antimony or phosphorus to a copper alloy containing 30% by weight zinc has some beneficial effects upon the corrosion resistance of the alloy. None of these references, either the U.S. patents or the Japanese articles, disclose the particular alloy system which will be disclosed in the present specification.

Therefore, it is a principal object of the present invention to provide an alloy system which is highly resistant to corrosion without being high in cost.

It is a further object of the present invention to provide an alloy system as aforesaid which demonstrates increased resistance to corrosion in waters known to attack commercially available corrosion resistant alloys and particularly in sulfide containing waters.

It is yet a further object of the present invention to provide an alloy system as aforesaid which retains single phase properties within the alloy structure after processing to increase corrosion resistance properties.

Further objects and advantages of the present invention will become apparent from a consideration of the following specification.

SUMMARY OF THE INVENTION

The alloy system of the present invention fulfills the objects and advantages noted above by utilizing alloying additions of nickel, zinc and iron in a copper base with optional additions of cobalt and manganese. Further alloying elements such as arsenic, antimony and phosphorus may be included in the alloy system as inhibiting agents. This alloy system exhibits improved corrosion resistance in polluted water conditions when compared to the widely used Alloy 443 (Arsenical Admiralty Brass) and comparable corrosion resistance to the commonly used Alloy 706 (copper-10% nickel). This alloy system should be processed in such a manner so as to maintain a single phase within the alloy structure since multiple phases within the structure have an inherently detrimental effect upon corrosion resistance performance.

DETAILED DESCRIPTION

The alloy system of the present invention incorporates the addition of various alloying elements in a copper base. In particular, these elements are 8 to 20% by weight zinc, 3 to 7% by weight nickel and 0.3 to 5% by weight iron. From 0.2 to 1% by weight cobalt and from 0.001 to 1% by weight manganese may also be added to this alloy system. From 0.01 to 2% by weight of an element selected from the group consisting of arsenic, antimony and phosphorus, or combinations thereof, may be added to the alloy system as parting inhibitors.

Preferably, the alloy system of the present invention consists essentially of 14 to 20% by weight zinc, 4 to 6% by weight nickel, 1 to 2% by weight iron, balance copper. The preferable additions of cobalt and manganese range from 0.3 to 0.7% by weight for cobalt and from 0.003 to 0.4% by weight for manganese. The elements listed above as parting inhibitors may also be added, singly or in combination, to the preferred alloy system.

The processing of this alloy system follows conventional practice, provided that the alloy retain its single phase throughout all steps of the processing. The alloy system undergoes both hot and cold working to an initial reduction gauge, followed by annealing and cold working in cycles down to the final desired gauge.

The alloy of the present invention may be cast in any convenient manner such as Durville, direct chill or continuous casting. The alloy should be homogenized at a minimum temperature of 500° C. and a maximum temperature of 1050° C., or the solidus temperature, whichever is lower for the particular alloy, for at least 15 minutes. This homogenization is then followed by hot working of the alloy, for example by hot rolling, at a finishing temperature of at least 400° C. and preferably between 650° and 950° C. The alloy should be rapidly quenched, preferably using a water bath, after being hot worked in order to insure a solid solution microstructure within the alloy.

The alloy is then cold worked at a temperature below 200° C. with or without intermediate annealing depending upon the particular gauge requirements in the final strip material. In general, annealing may be performed using either strip or batch processing with holding times of from 10 seconds to 24 hours at temperatures ranging from 525° C. to 1050° C. or within 50° C. of the solidus temperature for the particular alloy. Following annealing, the alloy is rapidly quenched, preferably using a water bath, to retain a single phase microstructure.

The process of the present invention and the advantages obtained thereby may be more readily understood from a consideration of the following illustrative examples. All percentages for the alloying additions will be in terms of weight percent.

EXAMPLE I

An alloy containing 14.7% Zn, 4.9% Ni, 1.39% Fe, 0.033% Mn, balance Cu (Alloy 1) was cast as a Durville ingot and was hot and cold worked by conventional practice to a 0.030" gauge. The worked material was then annealed at 850° C. for one hour and tested together with strip material formed from Alloys 706 and 443 as controls in a loop test containing a 3.4% NaCl solution which was alternately sulfidated each day with 10 ppm $HS^-$ for 4 hours and then fully oxygenated at 25° C. The weight loss and corrosion rate after 90 days exposure together with the deepest localized attack are shown in Table I.

TABLE I

COMPARISON OF 90-DAY WEIGHT LOSS AND CORROSION RATE PLUS DEEPEST ATTACK

| Alloy | 90-Day Wt. Loss mg/cm$^2$ | 90-Day Corrosion Rate, mpy | Deepest Attack, Mils |
|---|---|---|---|
| Alloy 1 | 17.8 | 1.8 | 13.5 |
| Alloy 706 | 14.5 | 0.5 | 10.5 |
| Alloy 443 | 162.0 | 106.0 | 30.0 |

It can be seen from these results that Alloy 1 has a much superior corrosion resistance than Alloy 443 and approaches Alloy 706 on corrosion rate and depth of attack considerations.

EXAMPLE II

An alloy containing 19.6% Zn, 5.0% Ni, 1.32% Fe, 0.078% Mn, balance Cu (Alloy 2) was processed in a similar manner as in Example I and was compared to the same control materials utilized in Example I in an identical testing situation. The results are shown in Table II.

TABLE II

COMPARISON OF 90-DAY WEIGHT LOSS AND CORROSION RATE PLUS DEEPEST ATTACK

| Alloy | 90-Day Wt. Loss mg/cm$^2$ | 90-Day Corrosion Rate, mpy | Deepest Attack, Mils |
|---|---|---|---|
| Alloy 2 | 15.5 | 0.5 | 6.5 |
| Alloy 706 | 14.5 | 0.5 | 10.5 |

TABLE II-continued

COMPARISON OF 90-DAY WEIGHT LOSS AND CORROSION RATE PLUS DEEPEST ATTACK

| Alloy | 90-Day Wt. Loss mg/cm$^2$ | 90-Day Corrosion Rate, mpy | Deepest Attack, Mils |
|---|---|---|---|
| Alloy 443 | 162.0 | 106.0 | 30.0 |

It can clearly be seen from the results in Table II that Alloy 2 has a much better corrosion resistance than does Alloy 443 and is equivalent to Alloy 706 in corrosion rate performance. The deepest localized corrosion attack of Alloy 2 is the least of all the alloys tested.

As can be seen from these examples, the alloy system of the present invention provides equivalent or greater corrosion resistance or resistance to localized corrosion than commercial Alloy 706 in polluted water testing. This alloy system is intended as a lower cost replacement for Alloy 706 in those applications which require at least equivalent resistance to corrosion. At present, Alloy 706 is not economically competitive with such materials as 304 stainless steels. Reduction of the nickel content and thus reduction of the cost brought about by the alloy system of the present invention without appreciably sacrificing corrosion resistance properties produces an alloy with much more favorable economics to those contemplating the use of copper alloys in tubing applications. The alloy of the present invention may also be utilized in various other applications, such as those applications which utilize the material for its strength properties or those which utilize the material for its pleasing appearance. For example, the alloy of the present invention may be useful as construction material and may also be useful in furniture or decorative applications. Various other uses of this alloy system will depend upon the particular property or properties desired by the fabricator in the final product.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A method of producing a wrought copper base alloy which is particularly useful in applications requiring corrosion resistance, said process comprising the steps of:

(a) providing an aluminum free cast alloy consisting essentially of 8 to 20% by weight zinc, 3 to 7% by weight nickel, 0.3 to 5% by weight iron, balance copper;

(b) homogenizing said alloy at a minimum temperature of 500° C. for at least 15 minutes;

(c) hot working said alloy with a finishing temperature of at least 400° C.;

(d) rapidly cooling the hot worked alloy from said finishing temperature to provide a single phase solid solution microstructure within the alloy; and (e) cold working said alloy at a temperature below 200° C.

2. A method according to claim 1 wherein said homogenization is performed at a temperature of from 500° C. to the solidus temperature of the particular alloy.

3. A method according to claim 1 wherein said hot working is performed at a temperature range of from 650° to 950° C.

4. A method according to claim 1 wherein said rapid cooling is a water quench.

5. A method according to claim 1 wherein 0.001 to 1% by weight manganese is also present in said alloy.

6. A method according to claim 1 wherein 0.01 to 2% by weight for each of the elements selected from the group consisting of arsenic, antimony and phosphorus, or combinations thereof, is also present in said alloy.

7. A method according to claim 1 wherein said alloy consists essentially of 14 to 20% by weight zinc, 4 to 6% by weight nickel, 1 to 2% by weight iron, balance copper.

8. A method according to claim 1 wherein said cold working is performed in cycles with intermediate annealing from 525 to within 50° C. of the solidus temperature for the particular alloy from 10 seconds to 24 hours and said alloy is rapidly cooled after annealing to retain a single phase microstructure.

9. A method according to claim 8 wherein said annealing comprises strip or batch annealing and is performed at a temperature of from 525° to 1050° C.

10. A method according to claim 8 wherein said rapid cooling is a water quench.

11. A method of producing a wrought copper base alloy which is particularly useful in applications requiring corrosion resistance, said process comprising the steps of:

(a) providing an aluminum free cast alloy consisting essentially of 8 to 20% by weight zinc, 3 to 7% by weight nickel, 0.3 to 5% by weight iron, 0.2 to 1% by weight cobalt, balance copper;
(b) homogenizing said alloy at a minimum temperature of 500° C. for at least 15 minutes;
(c) hot working said alloy at a temperature of at least 400° C.;
(d) rapidly cooling the hot worked alloy to insure a solid solution microstructure within the alloy; and
(e) cold working said alloy at a temperature below 200° C.

12. A method of producing a wrought copper base alloy which is particularly useful in applications requiring corrosion resistance, said process comprising the steps of:

(a) providing an aluminum free cast alloy consisting essentially of 14 to 20% by weight zinc, 4 to 6% by weight nickel, 1 to 2% by weight iron, 0.3 to 0.7% by weight cobalt, balance copper;
(b) homogenizing said alloy at a minimum temperature of 500° C. for at least 15 minutes;
(c) hot working said alloy at a temperature of at least 400° C.;
(d) rapidly cooling the hot worked alloy to insure a solid solution microstructure within the alloy; and
(e) cold working said alloy at a temperature below 200° C.

13. A method of producing a wrought copper base alloy which is particularly useful in applications requiring corrosion resistance, said process comprising the steps of:

(a) providing an aluminum free cast alloy consisting essentially of 14 to 20% by weight zinc, 4 to 6% by weight nickel, 1 to 2% by weight iron, 0.003 to 0.4% by weight manganese, balance copper;
(b) homogenizing said alloy at a minimum temperature of 500° C. for at least 15 minutes;
(c) hot working said alloy at a temperature of at least 400° C.;
(d) rapidly cooling the hot worked alloy to insure a solid solution microstructure within the alloy; and
(e) cold working said alloy at a temperature below 200° C.

14. A method of producing a wrought copper base alloy which is particularly useful in applications requiring corrosion resistance, said process comprising the steps of:

(a) providing an aluminum free cast alloy consisting essentially of 14 to 20% by weight zinc, 4 to 6% by weight nickel, 1 to 2% bt weight iron, an element selected from the group consisting of 0.01 to 2% by weight arsenic, 0.01 to 2% by weight antimony and 0.01 to 2% by weight phosphorus, and mixtures thereof, balance copper;
(b) homogenizing said alloy at a minimum temperature of 500° C. for at least 15 minutes;
(c) hot working said alloy at a temperature of at least 400° C.;
(d) rapidly cooling the hot worked alloy to insure a solid solution microstructure within the alloy; and
(e) cold working said alloy at a temperature below 200° C.

* * * * *